United States Patent [19]

Cournover et al.

[11] 4,306,736

[45] Dec. 22, 1981

[54] DOCUMENT HOLDER

[75] Inventors: Bernard T. Cournover, Holden; Norman A. Hedstrom; Robert G. Borgren, both of Worcester; David M. Wright, Shrewsbury, all of Mass.

[73] Assignee: Wright Line Inc., Worcester, Mass.

[21] Appl. No.: 112,854

[22] Filed: Jan. 17, 1980

[51] Int. Cl.[3] ..... B42F 13/00

[52] U.S. Cl. ..... 281/15 A; 402/80 P

[58] Field of Search ..... 402/4, 38, 80 P; 312/233, 184, 294, 323, 328, 343; 281/15 A, 15 B, 45, 46

[56] References Cited

U.S. PATENT DOCUMENTS

| | | | |
|---|---|---|---|
| 2,494,382 | 1/1950 | Faulkner | 312/343 X |
| 2,794,697 | 6/1957 | Bergman | 312/328 X |
| 3,865,445 | 2/1975 | Dean | 402/4 |
| 3,980,360 | 9/1976 | Wright | 402/38 X |
| 4,056,296 | 11/1977 | Hedstrom | 402/38 X |

*Primary Examiner*—Paul A. Bell

*Assistant Examiner*—John S. Brown

*Attorney, Agent, or Firm*—Milton E. Gilbert; Gary E. Ross

[57] ABSTRACT

A document holder or filing device comprising a rigid spine piece dimensioned to accommodate the spine of the binding of a book-like item to be filed, said spine piece having head and tail ends, and at least one finger at both head and tail ends dimensioned and movably disposed to engage the associated head and tail ends of the spine between themselves and the spine piece, first and second interlocking means so configured and disposed as to be engageable one with the other and, when engaged, prevent the further relative movement of the fingers and thereby maintain the book-like item captive within the holder, and resiliently distortable means biased so as to maintain said first and second interlocking means in engagement and manually distortable so as to permit the disengagement of the interlocking means and thereby the release of the binder from the document holder.

20 Claims, 9 Drawing Figures

DOCUMENT HOLDER

This invention relates to document holders, and more particularly to devices provided with an eccentrically located pivotal suspension for both suspension filing and display of permanently- or temporarily-bound materials.

BACKGROUND OF THE INVENTION

Document holders designed for use in suspension filing and display systems are well known. A commonly encountered device of this type utilizes an eccentrically located pivotal suspension to rotatably support, in a filing system of the type comprising a single supporting hanger, bound documents in either a closed, spine-up filed position or an open, spine-down displayed position. Among such holders are those designed to accommodate bound or sectioned materials, such as periodicals, catalogues, directories and the like, typically by holding such materials captive to the holder by one or more wires or bands attached to the holder, inserted in the fold between adjacent leaves, and extending from the head to the tail of the material. Such holders are shown in connection with filing and display systems in U.S. Pat. Nos. 2,494,382 and 2,794,697. Also well known are document holders designed for use with similar filing and display systems which incorporate posts designed to hold captively assembled to the holders looseleaf documents, such as computer printouts, at least one margin of which has been provided with a plurality of appropriate apertures. Such document holders are exemplified in U.S. Pat. Nos. 3,980,360 and 4,056,296.

In the case of the first of these types of document holders, the installation and removal of documents is often cumbersome. While not necessarily a disadvantage (indeed, in such applications as the public storage and display of documents it becomes an advantage) this aspect of these devices is not always desirable. Further, it should be noted that in the case of documents which are bound only in individual sections, such as magazines and brochures, the number of individual items which can be accommodate in a single holder is severly limited by the number of bands. The second type of document holder, while not as severaly limiting the number of items which can be accommodate in a single holder, suffers in some applications in that intercalation of items is cumbersome.

In copending application Ser. No. 102,150, filed Dec. 10, 1979 by Norman A. Hedstrom et al, for Document Holder, the assignment of which is held in common with that of the present application, there is disclosed a document holder designed to overcome these problems by detachably securing the head and tail ends of the spine of a bound item to a rigid spine piece by a pair of pluralities of short finger-like tabs. These pluralities are designed so as to be movable relative to each other, and are normally defeatably restrained in the position securing the bound item. The defeatable restraint is provided, in a preferred embodiment, by a spring, although equivalent means, such as a screw adjustment, are also indicated.

It will be recognized that in the case of heavy bound items, the spring actuated holder may be used in a pivotal filing and display system only if the fingers restrained by the spring are situated at the head end of the spine. As the head end of the document is the end which is normally exposed and manipulated in such filing and display systems, the spring actuated document holder provides opportunity for inadvertent detachment of the document. While alternative restraining means such as a screw adjustment may be used to overcome this potential problem, such restraining means are not only somewhat more complex to manufacture but are also not as convenient from the standpoint of the user.

OBJECTS OF THE INVENTION

It is an object of the present invention to provide a document holder of this last mentioned type which does not require a spring or screw adjustment, and is therefore simpler and less expensive to manufacture.

Yet a further object is to provide a document holder wherein the movable portion may be located at the tail end of the document providing greater security from accidental disengagement of the document.

SUMMARY OF THE INVENTION

These and other objects are met in the present invention of a document holder in which a rigid spine piece, dimensioned to accommodate the spine of the binding of the document to be filed and displayed, is provided with a plurality of fingers at both head and tail ends, the fingers being so dimensioned and disposed as to engage the head and tail of the spine of the document between themselves and the spine piece. Installation and removal of documents in and from the spine piece is facilitated by provision for displacing the fingers at one end of the spine piece away from and toward the fingers at the other end. The movable fingers are normally restrained in the position engaging the spine of the document by a ratchet-type mechanism incorporated in the spine piece and a resiliently distortable portion of the movable finger piece. The spine piece is provided with an eccentrically located hook for mounting the holder to a filing system of the type comprising a single supporting hanger. Document holders made in accordance with the principals of the present invention may be readily dimensioned to accommodate standard ring-type looseleaf binders, thereby providing means for the ready intercalation of items in a document storage and display system.

Other features and many of the advantages of the invention are set forth in or rendered obvious by the following detailed description in consideration of the accompanying drawings.

BRIEF DESCRIPTION OF THE DRAWINGS

In the several views, like numbers are used to designate like parts, so as to facilitate a concise description of the invention.

DETAILED DESCRIPTION

Figure 1:
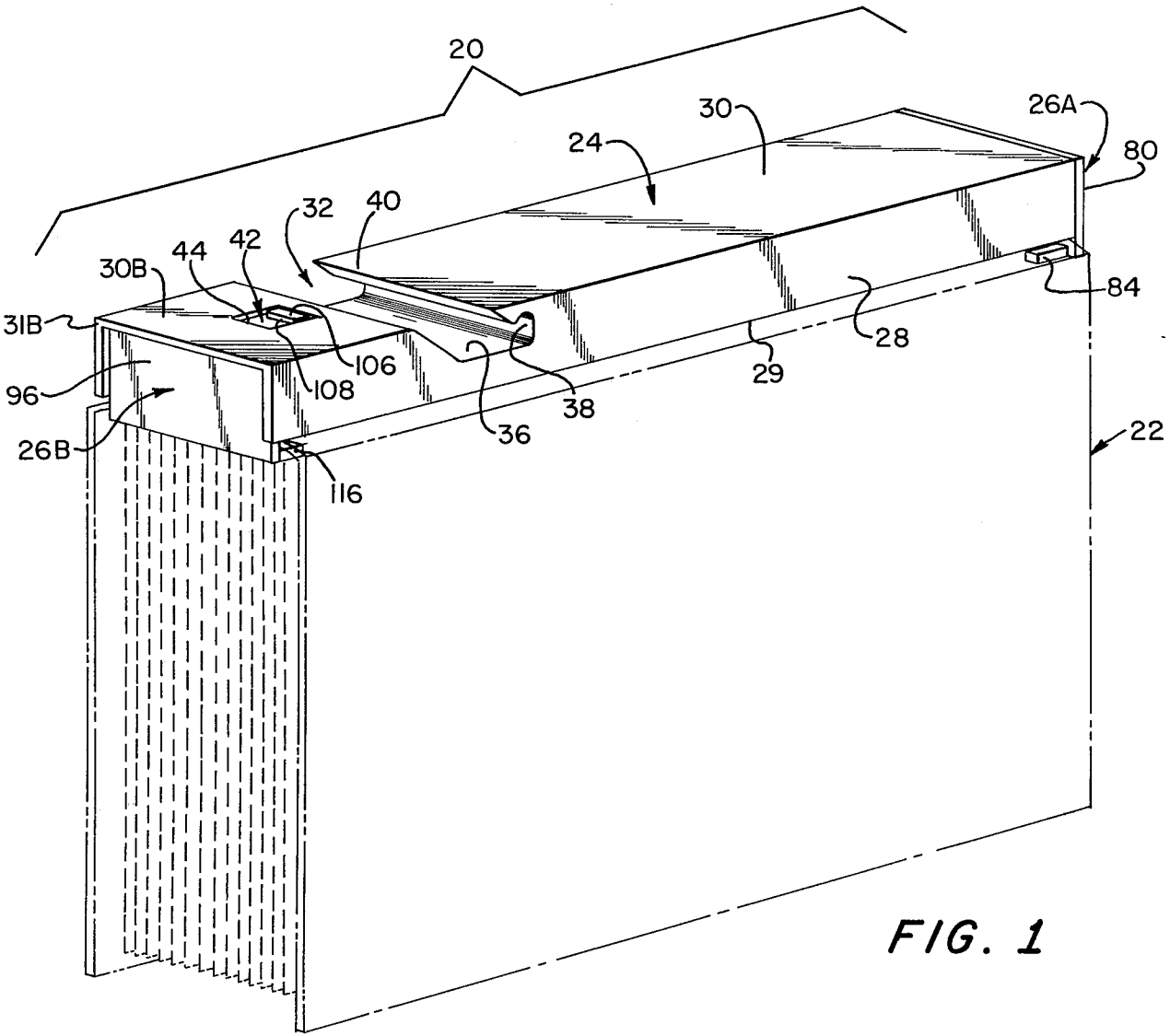
FIG. 1 is a perspective view, from above and to the side, of a document holder constituting a preferred embodiment of the invention carrying a looseleaf notebook, indicated in phantom.

Referring now in greater detail to the drawings, there may be seen in FIG. 1 an illustration of a hanging type document holder 20 designed to accommodate permanently or temporarily bound materials, typified by a conventional looseleaf binder 22, shown in phantom, and to secure such materials detachably to a suspension filing system of the type having a single center suspension rail. Holder 20 comprises an elongate spine 24 and head and tail end pieces 26A and 26B which may be fabricated out of any substantially rigid yet resiliently distortable material. By way of example but not limitation, the spine and end pieces may be molded of a synthetic polymer such as medium or high density polyethylene, polystyrene or the like.

Figure 6:
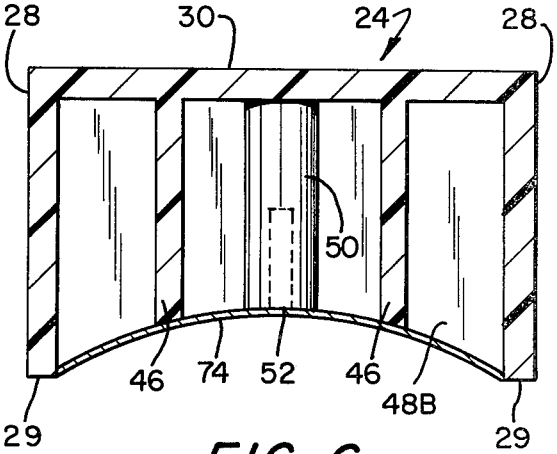
FIG. 6 is a cross-sectional view of the document holder taken along the line 6—6 of FIG. 3.
Figure 7:
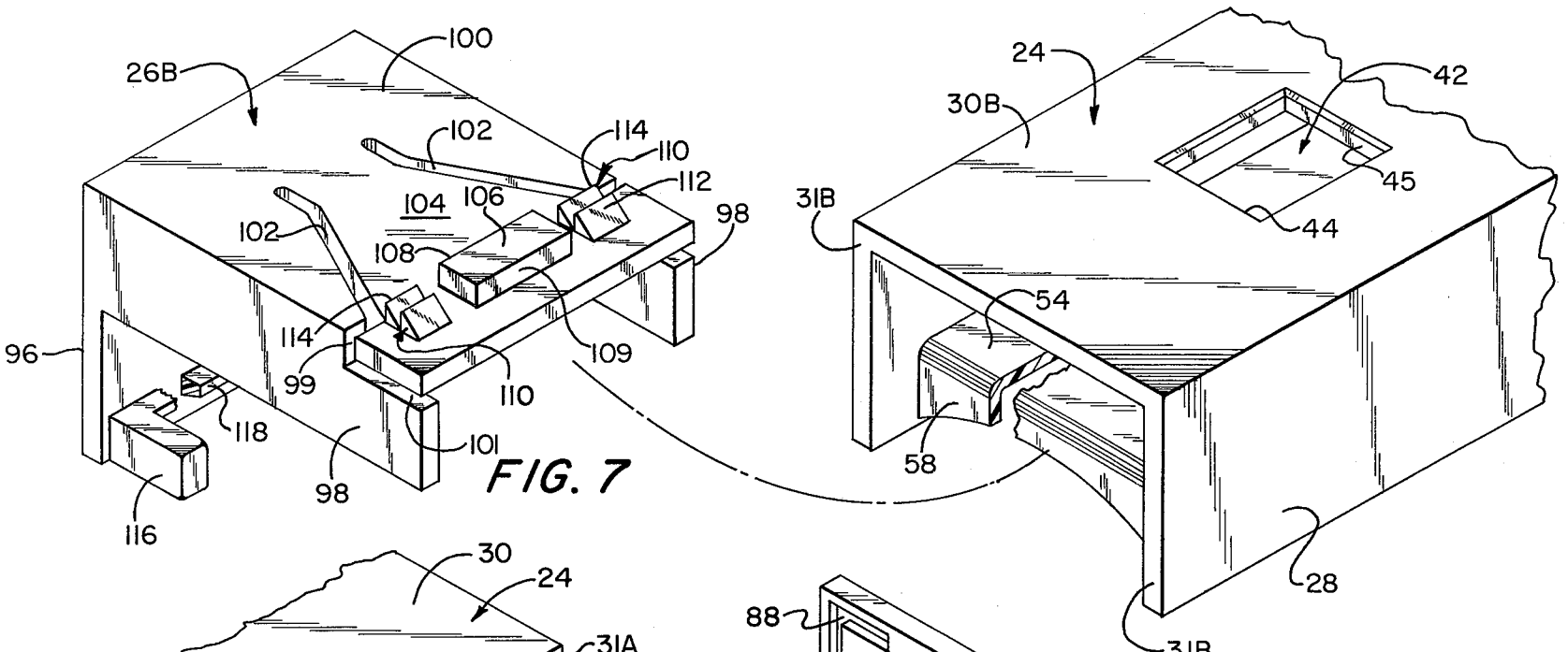
FIG. 7 is a fragmentary exploded view, cut away in part to reveal details, of the head end of the document holder.
Figure 8:
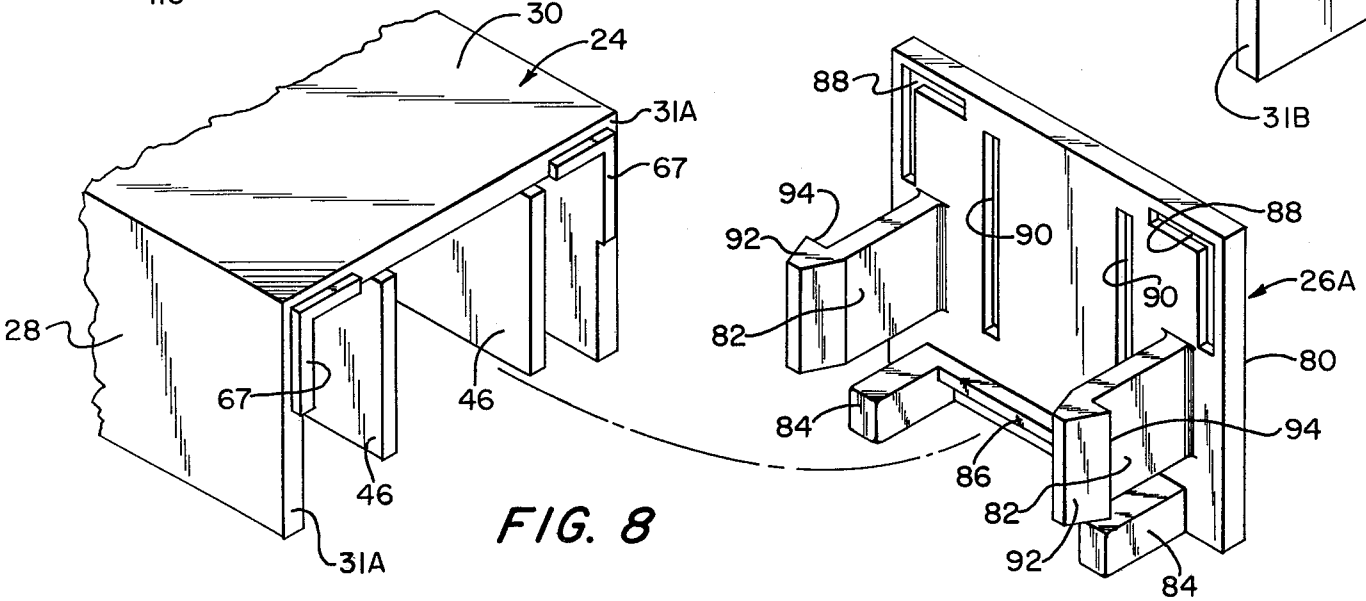
FIG. 8 is a fragmentary exploded view cut away in part to reveal detail, of the tail end of the document holder.

The overall form of spine 24 is that of an open ended elongate channel, as may be seen by reference to the fragmentary exploded views in FIGS. 7 and 8. More particularly, spine 24 comprises a pair of mutually parallel relatively thin-walled planar sides 28 attached normal to the included relatively thin-walled planar back 30. In general outline, sides 28 and back 30 are each substantially rectangular, each long edge of the rectangle bounding back 30 being common with a long edge of the rectangle bounding the corresponding side 28. The long edges of the rectangles bounding sides 28 distal from back 30 define a pair of edges 29 which are substantially coplanar and equidistant from the plane of back 30, as may be seen with reference to FIGS. 5 and 6. In the longitudinal direction, sides 28 and back 30 are conterminous, terminating in planar lips 31A and 31B, shown in FIG. 2, at respectively the head and tail ends of spine 24 (i.e., the ends of spine 24 designed to accommodate respectively the head and tail of binder 22). The length of spine 24, as measured from lip 31A to lip 31B, is chosen to be slightly greater than the height of the particular binder 22 to be accommodated, while the width of the spine, from side to side, is chosen to be on the order of the width of the binder. The height of sides 28, as measured from edges 29 to back 30, is chosen to accommodate the structure described hereinafter, while the thicknesses of the walls constituting sides 28 and back 30 are chosen on the basis of the strength of the material from which they are fabricated, and to accommodate the latching structure to be described.

Figure 3:
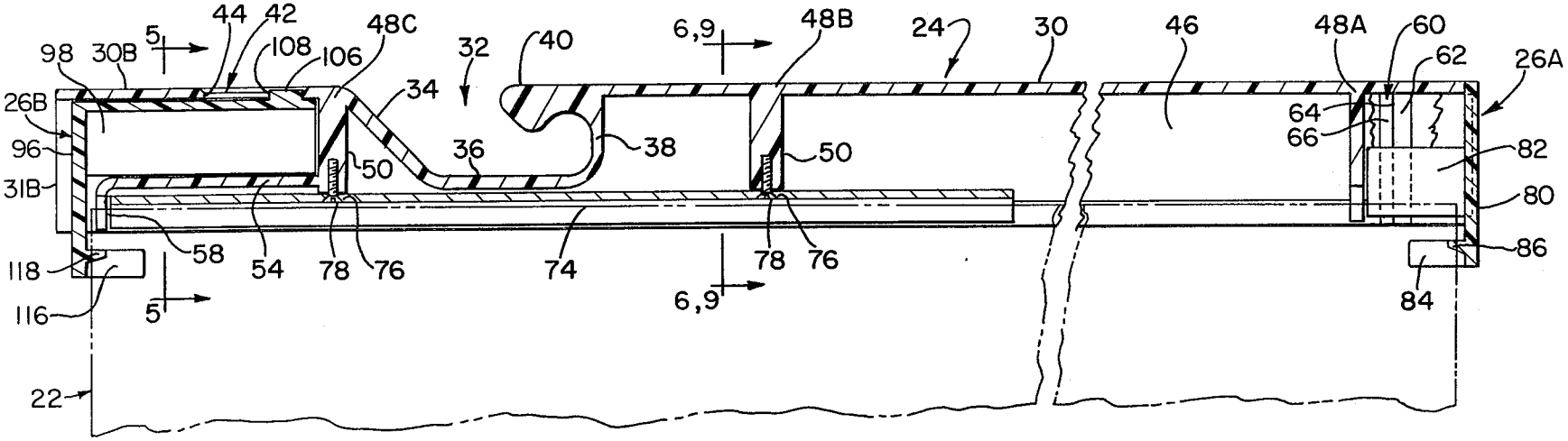
FIG. 3 is a longitudinal sectional view, taken along the line 3—3 of FIG. 2, of the document holder.

Referring to FIGS. 1 and 3, it may be seen that a hook, identified generally by numeral 32, interrupts the back and sides of spine 24. Hook 32 comprises inclined face 34, bottom face 36, wall 38, and hooked tab 40, all of which extend between, and substantially normal to, sides 28. Inclined face 34 is disposed at an angle, preferably 45° as shown, to the plane of back 30, joining back 30 along a line displaced toward tail lip 31B from the center of the back, and extending toward edges 29 of sides 28 the further inclined face 34 becomes from lip 31B. The end of inclined face 34 distal from back 30 terminates in bottom face 36, which is essentially planar and parallel to the plane of back 30. Opposite inclined wall section 34 back 30 is interrupted by hooked tab 40, beneath which, in the direction of lips 31A and edges 29, is recessed wall 38. Wall 38 joins back 30 at tab 40 and is disposed substantially normal to the back. Wall 38 extends from back 30 to bottom face 36. In a preferred embodiment, wall section 38 is displaced toward tail lip 31B from the center of the back, although it will be understood it may be located so as to center hooked tab 40, if desired. It will be understood that the disposition of inclined face 34, bottom face 36, wall 38 and hooked tab 40 relative to one another must be such as to accommodate the supporting structure of the filing system with which spine 24 is to be used, and further, that this disposition need not be uncentered, as it is in the preferred embodiment, but may be so arranged that hook 32 is centered along spine 24. It should be noted, however, that although the placement of hook 32 may be varied, it must be such that the distance betwen tail lip 31B and the junction of back 30 and inclined face 34 is at least on the order of twice the variation of heights of binders 22 to be accommodated by the holder (the height of the binder 22 is the dimension extending lengthwise of holder 20).

Figure 2:
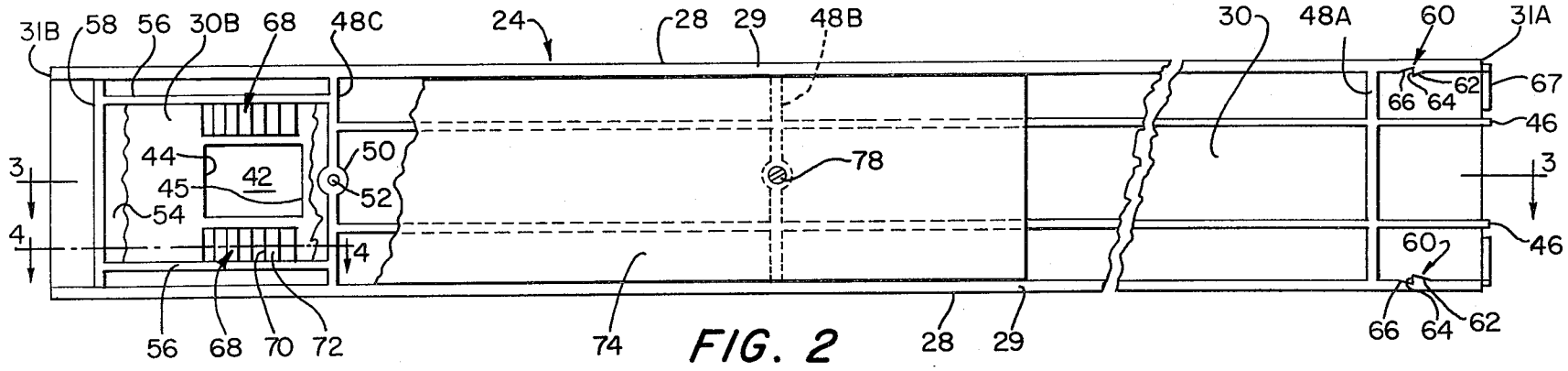
FIG. 2 is a fragmentary plan view, from below, of the interior of the spine portion of the document holder of FIG. 1, with portions of the structure broken away to reveal significant details.

Referring to FIGS. 2 and 7, it may be seen that back 30 is provided with an aperture 42 disposed on that portion of the back, indicated by index number 30B for clarity, which lies between hook 32 and tail lip 31B. Aperture 42 is rectangular in plan, with its long axis substantially coincident with the longitudinal axis of back 30. The edge of aperture 42 nearest tail lip 31B is located about halfway from the tail lip to the junction of the back and inclined face 34; this edge is finished in a substantially planar surface normal to the plane of back 30, forming latch face 44. The opposite edge of aperture 42 is likewise substantially planar to back 30, and forms stop face 45. The overall dimensions of aperture 42 are chosen to accommodate a fingertip (i.e. a minimum opening of about 1.5 cm by 2 cm), and from considerations of the range of heights of binders 22 to be accommodated, as will be described.

The interior of spine 24 is provided with a pair of longitudinal reinforcing ribs 46, and three lateral reinforcing ribs 48A, 48B and 48C, located near the head end, midpoint, and tail end of the spine, respectively, as may be seen by reference to FIGS. 2 and 3. All of these reinforcing ribs are thin, substantially planar walls with thicknesses on the order of the thickness of back 30, disposed substantially normal to the plane of back 30 and extending therefrom toward the plane of edges 29. Longitudinal reinforcing ribs 46 are disposed parallel to sides 28 and situated approximately midway from the longitudinal axis of the spine toward either side. Lateral reinforcing ribs 48A, 48B and 48C are disposed normal to sides 28, extending therebetween. Lateral reinforcing rib 48A is located near head lip 31A, but sufficiently clear of the lip to permit structure for the attachment of head end piece 26A, as will be described hereinafter. Lateral reinforcing rib 48B is situated substantially at the midpont of spine 24, and lateral reinforcing rib 48C is located substantially at the joint between inclined face 34 and the tail end section 30B of the back. Longitudinal reinforcing ribs 46 extend from tail end lateral reinforcing rib 48C connecting with inclined face 34, bottom face 36, wall 38 and back 30 and each of the lateral reinforcing ribs, to about one half the thickness of back 30 beyond tail lip 31B, where they terminate in edges parallel to the plane of the tail lip. The termination of the reinforcing ribs nearest the plane of edges 29 is determined by the spine of the document or binder 22 to be accommodated. In a preferred embodiment, the edges of lateral reinforcing ribs 48A, 48B and 48C are arcuate, to accommodate a document with a convex spine, and longitudinal reinforcing ribs 46 extend from back 30 correspondingly, as may be seen by reference to FIG. 6. Mid- and tail reinforcing ribs 48B and 48C respectively, are provided with cylindrical posts 50, situated at the midpoints of the reinforcing ribs and extending at right angles from back 30 for the full height (i.e., the distance normal to back 30) of the reinforcing ribs, as may be seen in FIGS. 2 and 3. Each post 50 is provided with a blind axially tapped hole 52.

Figure 4:
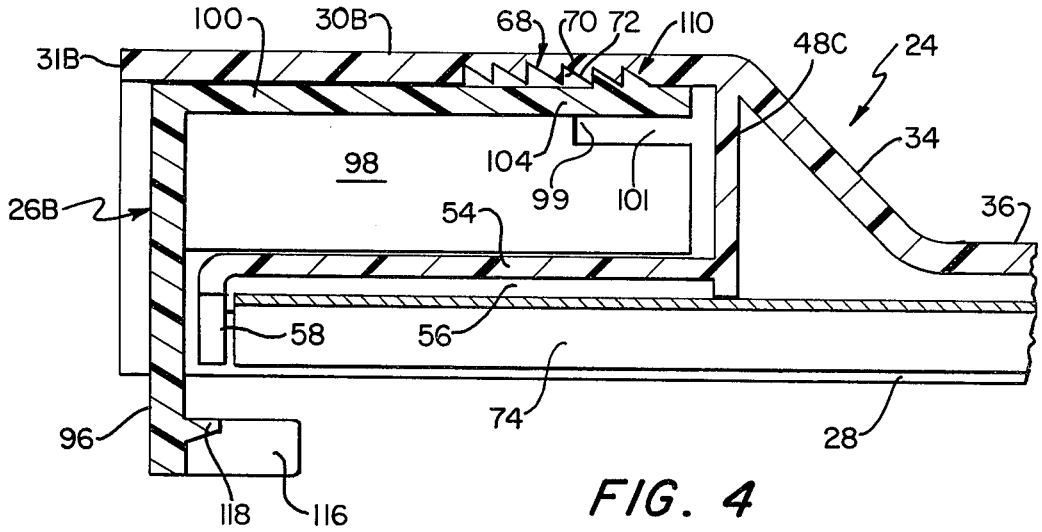
FIG. 4 is a detailed longitudinal sectional view, taken along the line 4—4 of FIG. 2, of a significant portion of the document holder of FIG. 1.
Figure 5:
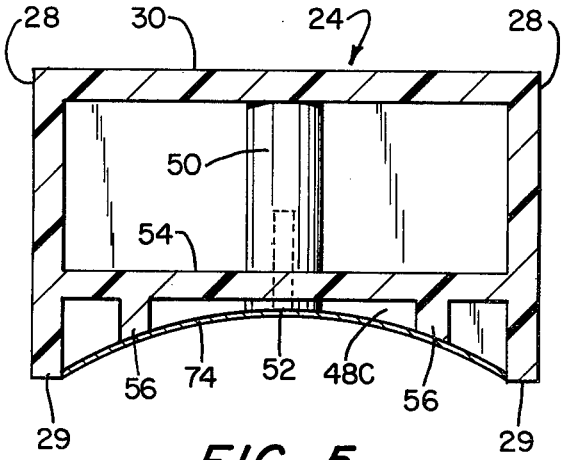
FIG. 5 is a cross-sectional view of the document holder taken along the line 5—5 of FIG. 3.

The tail end of spine 24 is provided with an integral shelf 54, shown in detail in FIGS. 4 and 5. Shelf 54 is a thin-walled planar sheet extending parallel to back 30B between sides 28 and from tail lateral reinforcing rib 48C toward tail lip 31B. The distance of shelf 54 from back 30 is chosen to be slightly less than the minimum height of tail lateral reinforcing rib 48C, so that a portion of the reinforcing rib, even at its minimum height, extends beyond the shelf. Shelf 54 is provided with a pair of longitudinal shelf supports 56, and, at its end distal from lateral reinforcing rib 48C, a lateral shelf support 58. Shelf supports 56 and 58 are all substantially planar thin walls normal to the plane of shelf 54 and extending from the shelf toward the plane of edges 29. Longitudinal shelf supports 56 are parallel to sides 28, and extend between tail lateral reinforcing rib 48C and lateral shelf support 58. Lateral shelf support 58 extends between sides 29 and is disposed substantially parallel to the plane of tail lips 31B. The edge of lateral shelf support 58 distal from back 30 is configured and disposed as are the corresponding edges of lateral reinforcing ribs 48A, 48B and 48C, and the heights of longitudinal shelf supports 56 are chosen such that the longitudinal shelf supports terminate within the envelope defined by these edges. Lateral shelf support 58, which forms the edge of shelf 54 distal from lateral reinforcing rib 48C, is so disposed that the outside distance between it and head lip 31A is slightly shorter than the height of the shortest book or binder 22 to be accommodated by document holder 20.

Turning again to FIGS. 2 and 3, there may be seen latch structures 60 formed on the interior surfaces of sides 28 between head lateral reinforcing rib 48A and head lip 31A. Latch structure 60 comprises, in order of distance from head lip 31A, head sloping face 62, latch face 64 and tail sloping face 66. Sloping faces 62 and 66 are substantially planar and of rectangular plan, with the long axes of the rectangles normal to back 30, and extend from back 30 to edges 29. Sloping faces 62 and 66 make slight angles (i.e., on the order of 15°) with their respective sides. Head sloping faces 62 taper inward, toward one another, increasing the thicknesses of their respective sides 28 to a maximum of about 1½ times nominal, as they increase in distance from head lip 31A. Distal from head lip 31A, head sloping faces 62 terminate by intersection with respective latch faces 64, which are substantially coplanar and rectangular in form and parallel to the plane of head lip 31A. Tail sloping faces 66 are so disposed parallel to head sloping faces 62, as to provide recesses in sides 28, joining latch faces 64 at their closest approach to head lip 31A where the side thicknesses are a minimum, each being about ½ the nominal thickness of a side. From this minimum side thickness, tail sloping faces 66 taper inward until sides 28 achieve their nominal thicknesses. Latch structure 60 is so disposed as to place latch face 64 a sufficient distance from head lip 31A to permit operation of the latch mechanism on head end piece 26A as will be described hereinafter.

The head end of spine 24 is also provided with a pair of locators 67 situated on head lip 31A, and best shown in FIG. 8. Locators 67 are L-shaped protuberances on the inner edges of the lip in the vicinities of the joints of sides 28 to back 30. The dimensions of locators 67 normal to the plane of head lip 31A and across the thickness of a side 28 or back 30 are chosen to be on the order of ½ the thickness of a side; the lengths of the parts of locators 67 along the lip are chosen on the basis of the strength of the material.

Referring to FIGS. 2 and 4, there may be seen ratchets 68 recessed into the interior of tail end back 30B. Ratchets 68 are situated on either side of aperture 42, and are comprised of pluralities of latch faces 70 and sloping faces 72 so arranged as to exhibit a saw-toothed cross-section running toward and away from tail lip 31B. Latch faces 70 are substantially planar surfaces of rectangular outline disposed parallel to and facing away from the plane of tail lip 31B with their long dimensions parallel to the plane of back 30B and one long edge coinciding with the interior surface of the remaining portions of back 30B. Adjacent latch faces 70 are spaced apart a distance on the order of the nominal increment between heights of standard sized bound items to be accommodated; in the case of loose-leaf binders, this dimension is on the order of 0.10 inch (2.5 millimeter). Adjacent latch faces 70 are separated from one another by sloping faces 72, which are also substantially planar surfaces of rectangular outline, the long dimensions of which coincide with those of the latch faces. Sloping faces 72 are so disposed as to make moderate angles (i.e., on the order of 30°) with the plane of back 30B, sloping so as to approach the plane of edges 29 as they become more distant from tail lip 31B. It will be appreciated that this angle, together with a spacing of 0.10 inch results in a change of thickness of back 30B on the order of 0.07 inch (1.8 millimeter) due to the incision of ratchet 68 into the back. As a consequence, the thickness of back 30B must be chosen to be greater than the depth of this incision even if from other structural considerations a smaller dimension would prove adequate. The longitudinal extent of each ratchet 68 is chosen to be a multiple of the spacing between latch faces 70 and is selected on the basis of the range of heights of the binders to be accommodated by document holder 20, and the range of motion of tail end piece 26B necessary for the disengagement of an attached binder, as will be described. The lateral extent of each ratachet 68 is determined primarily from considerations of the available space between aperture 42 and sides 28.

Spine 24 is provided with a reinforcing piece 74, as may be seen by reference to FIGS. 2–6. Reinforcing piece 74 is in the form of a thin sheet, preferably of metal, shaped to conform to the shape of the spine of the bound item to be accommodated and dimensioned to fit between sides 28 and extend from lateral shelf support 58 to beyond mid lateral reinforcing rib 48B. Reinforcing piece 74 is provided with a pair of apertures 76 located substantially along the medial line and so disposed and dimensioned as to be opposite and slightly larger than the tapped holes 52 in posts 50 when the reinforcing piece is resting on the posts and its end nearest lateral shelf support 58 is in place. It will be recognized that, by dimensioning the longitudinal extent of reinforcing piece 74 to be slightly less than the sum of the distance between mid lateral rib 48B and tail lateral rib 48C plus twice the longitudinal extent of shelf 54, and disposing apertures 76 equidistant from the midpoint, the assembly of the reinforcing piece to spine 24 may be facilitated. A pair of screws 78 dimensioned to engage tapped holes 52 secure reinforcing piece 74 to spine 24.

Turning now to FIG. 8 there may be seen head end piece 26A. Head end piece 26A is provided with an end wall 80 to which the rest of the structure of the end piece is affixed. End wall 80 is in the form of a thin rectangular plate, having a thickness on the order of that of a side 28 of spine 24, and so dimensioned as to cover and close an open end of the channel formed by the sides and back 30 of the spine, the width of end wall 80 being substantially the same as that of spine 24 and the height of the end wall being chosen to be substantially greater than that of a side 28 by an amount which depends upon the bound item to be secured to document holder 20, as will be described. Affixed to end wall 80, and extending in the same direction from and normal to the plane of the end wall are a pair of latch tongues 82, a pair of fingers 84, and a reinforcing shelf 86.

Latch tongues 82 are in the form of thin substantially rectangular sheets, the thicknesses of which are preferably on the order of that of end wall 80. Latch tongues 82 are each affixed by an edge of the end wall, and are so arranged that they are parallel to one another and to the edges of end wall 80 delimiting its width. The dimension of latch tongues 82 extending away from the end wall is chosen to be equal to the distance between latch face 64 and head lip 31A of spine 24. The remaining dimension (i.e the height) of each latch tongue 82 is chosen so as to offer sufficient strength to the tongue to insure the integrity of the assembled document holder 20 yet permit the resilient elastic distortion of the tongues toward one another, as will be described; for reasons which will become apparent, this dimension must be less than the interior height of a side 28. Each latch tongue 82 is affixed to end wall 80 so as to be displaced from the nearest edge of the end wall to which it is parallel by a distance substantially equal to $1\frac{1}{2}$ times the thickness of a side 28.

Fingers 84 are disposed adjacent one of the edges delimiting the height of end wall 80, and in line with the plane of latch tongues 82. Fingers 84 are elongate posts of rectangular cross-section, the long dimension of the cross-section being parallel to the planes of latch tongues 82. End wall 80 is dimensioned to have a height which exceeds this dimension of fingers 84 plus the height of a side 28 less the set back (an amount equal to the thickness of the spine of the binder 22 to be accommodated) of reinforcing piece 74 at the same location transverse the longitudinal axis of holder 20. The separation between latch tongues 82 and fingers 84 is similarly chosen to be equal to the thickness of the spine of binder 22. The length of fingers 84 (i.e., the extent of the fingers normal to end wall 80) is on the same order as the length of a latch tongue 82, and preferably slightly less than a small integral multiple of (e.g. 3x) the spacing between adjacent latch faces 70 of ratchets 68 in back 30 of spine 24. The remaining dimensions of fingers 84 is on the order of twice the thickness of a latch tongue, thereby insuring rigidity. The two fingers 84 affixed to end wall 80 are joined together by reinforcing shelf 86. Reinforcing shelf 86 is a thin substantially planar sheet of rectangular plan extending normal to end wall 80 and having its long dimension extending between fingers 84. Reinforcing shelf 86 is so disposed as to form a continuous, substantially planar surface from the surfaces of fingers 84 nearest latch tongues 82 and the corresponding surface of the reinforcing shelf. The height and length of reinforcing shelf 86 are both on the order of the thickness of end wall 80.

End wall 80 is also provided with locating sockets 88 and 90, intended to cooperatively engage with locators 67 and longitudinal reinforcing ribs 46, respectively. Locating sockets 88 are L-shaped grooves situated in the corners of end wall 80 distal from fingers 84, with the legs of the L's parallel to and about $\frac{1}{2}$ the thickness of a side 28 or back 30 from the edges of end wall 80. The width, and lengths of the legs of locating sockets 88 are dimensioned to tightly fit locators 67. Locating sockets 90 are disposed between latch tongues 82, parallel to one another and to the planes of the latch tongues. Locating sockets 90 are spaced apart by about the same distance as are longitudinal reinforcing ribs 46, and are substantially equidistant from the center of end wall 80. In length, width, and depth, locating sockets 90 match respectively the height, thickness, and extent beyond head lip 31A of longitudinal reinforcing ribs 46. Locating sockets 90 are disposed a distance of about the thickness of back 30 from the edge of end wall 80 distal from fingers 84.

Affixed to the ends of latch tongues 82 distal from end wall 80 are tapered sections 92 substantially in the form of planar faced right prisms, the altitudes of which are equal, and parallel, to the heights of the latch tongues. The bases of the prisms forming tapered sections 92 are trapezoidal in form, and are arranged to be coplanar with the edges which define the heights of latch tongues 82. The lateral faces of tapered sections 92 continuous with the edges of latch tongues 82 distal from end wall 80 are dimensioned to have areas on the order of twice that of these edges and are arranged to overhang these edges in directions away from one another by distances on the order of $\frac{1}{2}$ the thickness of a side 28, thereby forming latch faces 94, parallel to end wall 80. The lateral faces of tapered sections 92 adjacent latch faces 94 are disposed at a slight angle (i.e. on the order of 15°) to the planes of latch tongues 82. The tapered sections are so dimensioned that their furthest extent from end wall 80 is less than the distance between head lateral reinforcing rib 48A and head lip 31A.

Head end piece 26A is assembled to spine 24 by inserting latch tongues 82 into the channel formed by sides 28 and back 30, with end wall 80 parallel to head lip 31A and locating sockets 88 opposite locators 67. In this orientation of head end piece 26A, latch tongues 82 are parallel to and opposite the interior surfaces of sides 28 and fingers 84 are more distant from back 30 than is the plane of edges 29. As the end piece is forced inward, bring end wall 80 toward lip 31A, tapered sections 92 of the latch tongues encounter head sloping faces 62. Further inward motion of head end piece 26A results in the resilient distortion of latch tongues 82 away from their respective opposing sides 28, tapered sections 92 riding over head sloping faces 62. As catch faces 94 override latch faces 64, tapered sections 92 come opposite tail sloping faces 66, and latch tongues 82 spring back into parallel alignment, bringing the tapered sections into contact with the tail sloping faces and the catch and latch faces into engagement with one another. At the same time that this locking action takes place, restraining head end piece 26A from longitudinal motion away from head lip 31A, end wall 80 contacts head lip 31A, ending inward motion as well, and locators 67 and the ends of longitudinal reinforcing ribs 46, having entered locating sockets 88 and 90, respectively, further restrain the head end piece from lateral and vertical motions, relative to spine 24.

Turning now to FIG. 7, there may be seen tail end piece 26B. Tail end piece 26B is provided with an end wall 96 to which the rest of the structure of the end piece is affixed. End wall 96 is in the form of a thin rectangular sheet, having a thickness on the order of a side 28 of spine 24, and so dimensioned as to fit into and close the tail end of the channel formed by sides 28 and back 30B, the width of end wall 96 being substantially the same as the separation between sides 28 and the height of the end wall being substantially the same as that of end wall 80 less the thickness of back 30B. Affixed to end wall 96, and extending in the same direction from and normal to the plane of the end wall are a pair of side walls 98 and an included top wall 100. Side walls 98 and top wall 100 are in the form of thin, substantially rectangular sheets, the thicknesses of which are preferably on the order of that of end wall 96. Side walls 98 and top wall 100 are disposed on end wall 96 in the manner the sides and bottom of an inverted drawer are disposed on its front: side walls 98 being parallel to one another and to the edges of the end wall delimiting its width, while top wall 100 is normal to the side walls and extends between them. The side and top walls are positioned flush with three of the edges of end wall 96 and with each other, and so dimensioned as to fit smoothly into the space enclosed by sides 28, back 30B, and shelf 54. The extent of side walls 98 and top wall 100 in the direction normal to end wall 98 is chosen to be substantially the same as the distance between tail lateral reinforcing rib 48C and lateral shelf support 58, while the remaining dimensions of the top wall and the side walls are chosen to be slightly less than the remaining interior dimensions between shelf 54 and back 30B.

Side walls 98 distal from end wall 96 and adjacent top wall 100 are cut through, forming a pair of steps underlying the top wall, each comprised of a riser 99 parallel to the end wall and a tread 101 parallel to the top wall. Tread 101 is positioned to be normally clear of the lower surface of top wall 100 by a distance somewhat in excess of the thickness of back 30.

Top wall 100 is provided with a pair of slots 102 which penetrate through the top wall and extend from riser 99 on side walls 98 inwardly, approaching, but not meeting, both the end wall and each other. As a result, a portion of top wall 100 distal from end wall 96 is supported only by a narrow section of the top wall near the end wall, thereby forming resilient tab 104. It is preferable that the portion of each slot nearest end wall 96 be parallel to side walls 98. Consequently, in a preferred embodiment, each slot 102 is of half-wye plan, with serifs at the top of each wye half conterminous with risers 99. The extent of slots 102, and the spacing between them at their closest approach to end wall 96 are so chosen, from considerations of the resiliency of the material of top wall 100, as to permit the deflection away from the plane of the top wall of the end of resilient tab 104 distal from the end wall until the top wall contacts treads 101 (i.e., by a distance in excess of the thickness of back 30).

Disposed near the edge of resilient tab 104 distal from end wall 96 is latch tab 106. Latch tab 106 is substantially in the form of a rectangular parallelepiped, the faces of which are parallel to end wall 96, side walls 98 and top wall 100. Latch tab 106 is situated on the surface of top wall 100 which is conterminous with an edge of end wall 96, and is equidistant from both side walls 98. In the side-to-side direction, the extent of latch tab 106 is chosen to be somewhat less than the corresponding dimension of aperture 42 in back 30 of spine 24. Latch tab 106 extends normally from the surface of top wall 100 by a distance slightly less than the thickness of back 30. In a preferred embodiment, the remaining dimension of latch tab 106 is chosen to be less than the distance between latch face 44 and stop face 45 of aperture 42 by an amount equal to the sum of the length of a finger 84 and the difference between the extremes of the range in heights of binders 22 to be accommodated by document holder 20. The side of latch tab 106 nearest end wall 96 forms latch face 108, and that furthest from the end wall, stop face 109.

Disposed on resilient tab 104 on either side of latch tab 106 are ratchets 110. Ratchets 110 are in the form of a plurality of right triangular prisms, each affixed by one of its lateral faces to resilient tab 104 with its triangular bases parallel to side walls 96, its lateral edges parallel to end wall 96 and its lateral edge joining the right angles of the right triangular bases nearer the join of top wall 100 and end wall 96 than its remaining lateral edges. Ratchets 110 are spaced from latch tab 106 by a distance slightly greater than that by which ratchets 68 are spaced from aperture 42 in back 30. The lateral faces of the prisms bounded by the hypotenuses of the bases form sloping faces 112, which are disposed at the same angle relative to top wall 100 as sloping faces 72 of ratchets 68 are relative to back 30 of spine 24. The prisms' lateral faces parallel to end wall 96 form catch faces 114. Adjacent catch faces 114 are spaced apart a distance equal to the spacing between adjacent latch faces 70 of ratchets 68. As a consequence of the angle of sloping faces 112 and the spacing of catch faces 114, the maximum height of ratchets 110 normal to top wall 100 is the same as the maximum indentation of ratchets 68 into back 30. The lengths of the lateral edges of the prisms forming ratchets 110 are chosen to be slightly less than the corresponding dimension of ratchets 68. The number of individual catch faces 114 in each ratchet 110 is chosen on the basis of the strength of material from which the ratchet is formed.

The placement of ratchets 110 on tail end piece 26B and ratchets 68 on back 30 is established on the basis of the height of the shortest binder 22 to be accommodated. While disposing ratchets 110 so as to be near the edge of resilient tab 104 distal from end wall 96, ratchets 110 and 68 are so placed that the sum of the distance between end wall 96 and the catch face 114 most distant from it and the distance between head lip 31A and the latch face 70 nearest it is equal to the minimum binder height. Similarly, latch tab 106 and aperture 42 are so placed that the distance between stop face 109 and end wall 96 plus the distance between stop face 45 and head lip 31A equal the minimum height binder.

In a preferred embodiment, risers 99 are so placed as to be somewhat closer to end wall 96 than are latch tab 106 and ratchets 110.

Also known in FIG. 7 are fingers 116 and reinforcing shelf 118, affixed to the same surface of end wall 96 as are side walls 98 and top wall 110. Fingers 116 and reinforcing shelf 118 are identical in shape and dimensions to fingers 84 and reinforcing shelf 86, respectively, differing only in their disposition relative to the end wall. Fingers 116 are disposed orthogonally with respect to the edges of end wall 96 and adjacent the edge distal from top wall 100 and separated from the edges delimiting the width of the end wall by a distance of about ½ the thickness of a side 28.

Assembly of head end piece 26B to spine 24 may be readily accomplished by inserting side walls 98 and top wall 100 into the space bounded by sides 28, back 30B, and shelf 54, with top 100 in contact with the interior surface of back 30B. Inasmuch as latch tab 106 and ratchets 110 extend beyond the height of side walls 98, they must be displaced, through the resilient deflection of resilient tab 104 toward the plane of fingers 116, to permit the initial insertion of the end piece between back 30B and shelf 54. This stage of the assembly is facilitated by the overhang, produced by the slight extension of sides 28 and 30B beyond lateral shelf support 58, and by the location, near the edge of top wall 100 distal from end wall 96, of latch tab 106 and ratchets 110. This combination of overhang and location permits side and top walls, latch tab, and ratchets to be inserted into the open channel formed by sides 28 and back 30B up to the point of contact between side walls 98 and lateral shelf support 58 without deflecting resilient tab 104. Contact between latch tab 106 (or ratchets 110) and the interior surface of back 30B permits a deflecting force to be applied to resilient tab 104 through the relative motion of tail end piece 26B directed normally toward the plane of back 30B. Once resilient tab 104 has been deflected, side walls 98 can be inserted between back 30B and shelf 54, and dimensional constraints between the back and the shelf will maintain the elastic deformation of resilient tab 104. Continued motion of tail end piece 26B toward head lip 31A will eventually bring latch tab 106 opposite aperture 42 as ratchets 110 come opposite ratchets 68. When latch face 108 of latch tab 106 comes in line latch face 44 of aperture 42 and catch faces 114 of ratchets 110 come opposite latch face 70 of ratchets 68, resilient tab 104 is no longer restrained in its flexed condition by back 30B, and elastic restoring forces bring the resilient tab back into parallelism with the remaining portion of top wall 100. This action brings latch tab 106 into aperture 42 and ratchets 110 into engagement with ratchets 68. Tail end piece 26B is now in the normal fully opened position, with contact between latch faces 108 and 44 and catch and latch faces 114 and 70 preventing the enlargement of the separation between head and tail end pieces 26A and 26B without the deflection of resilient tab 104 through the manipulation of latch tab 106. Tail end piece 26B can, however, be moved closer to head end piece 26A without such manipulation, the cooperative action of sloping faces 72 and 112 of ratchets 68 and 110 during such closure automatically providing the deflection of resilient tab 104, permitting closure yet step-wise locking against opening as each catch and latch face overrides one another.

It will be appreciated that the positioning of treads 101 in side walls 98 is such as to permit the necessary deflection of resilient tab 104 for assembly and also for the proper functioning of ratchets 68 and 110. At the same time, contact of resilient tab 104 with treads 101 limits the travel of the resilient tab so as to prevent weakening of the flexed portion of the resilient tab at the ends of slots 102 nearest end wall 96.

Ratchets 68 and 110 provide an interlocking mechanism which normally prevents the motion of head and tail end pieces 26A and 26B away from one another.

Figure 9:
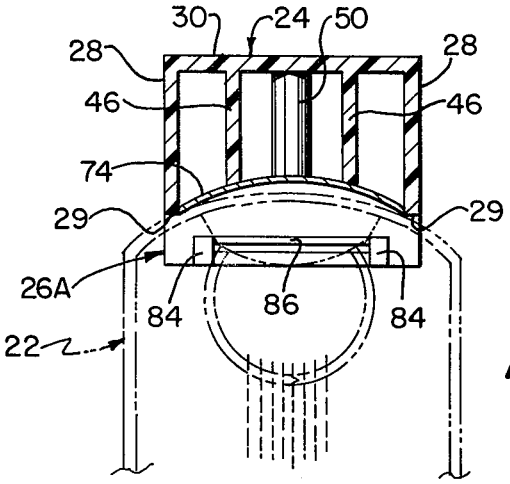
FIG. 9 is a reduced scale cross-sectional view of the document holder, taken along the line 9—9 of FIG. 3, showing, in phantom, a loose-leaf binder attached to the holder.

To apply document holder 20 to a bound article, such as binder 22, tail end piece 26B is first brought to its normally opened position. This is accomplished by depressing latch tab 106, thereby displacing resilient tab 104 away from back 30B and disengaging latch and catch faces 70 and 114 of ratchets 68 and 110, while simultaneously pulling tail end piece 26B away from head end piece 26A to the point where latch faces 44 and 108 of aperture 42 and latch tab 106 contact. The latch tab is now released, and document holder 20 is brought toward binder 22 with reinforcing piece 74 facing and parallel to the spine of the binder and head and tail end pieces 26A and 26B aligned with the head and tail of the binder, respectively. Fingers 84 of head end piece 26A are inserted into the binder so that the head end of the spine of the binder rests on end wall 80 of the end piece between fingers 84 and edges 29 of spine 24, as shown in FIG. 9. Without disturbing this relationship, the tail end of the spine of the binder is brought into contact with edges 29 and reinforcing piece 74, while simultaneously tail end piece 26B is forced toward head end piece 26A. This action automatically deflects resilient tab 104 as previously described, allowing the tail end piece to approach the head end piece. As the end pieces close together, fingers 116 of tail end piece 26B are inserted into the tail end of the spine of binder 22 to the point where end wall 96 contacts the binder, as shown in phantom in FIG. 3. Unless acted upon by some other force, the elastic restoring forces in resilient tab 104 will act, through sloping faces 72 and 112 of ratchets 68 and 110 to force into contact the latch and catch faces 70 and 114 corresponding to the separation between head and tail pieces 26A and 26B equal to or just larger than the height of binder 22, thereby locking the binder to document holder 20. This spring action of resilient tab 104 on ratchet 110, together with the orientation of latch and catch faces 70 and 114 insures support for binder 22, without the weight of the binder acting to move tail end piece 26B to its open position when the binder is displayed tail down.

To release binder 22 from document holder 20, latch tab 106 is depressed and tail end piece 26B is forced away from head end piece 26A till fingers 116 are clear of the tail of the spine of the binder.

When the holder is in use, suspending a document in a suspension filing system, the channel formed by sides 28 and back 30 is normally in the inverted position, as shown in FIG. 1. Inclined wall face 34 and bottom face 36 provide a pair of angularly disposed surfaces which facilitate the engagement of hooked tab 40 with a supporting rod of a filing system, not shown. It will be appreciated that the eccentric location of hook 32 will result in an imbalance of holder 20, with tail end piece 26B tending to rise above head end piece 26A. This deliberate imbalance particularly suits the holder of the present invention for use with filing systems of the type described in U.S. Pat. No. 3,980,360 wherein a flange, not shown, by contact on tail portion of back 30B both maintains the back horizontal in the stored position and provides, with the center of gravity of the holder, a couple which tends to better secure hook 32 on the supporting member of the filing system. In this type of storage and display system, the filed documents are normally handled by their head ends, and in the stored position, latch tab 106 is remote from the user. It will be appreciated that latch tab 106, by being designed to extend above resilient tab 104 by a distance less than the thickness of back 30B does not contact the filing system and therefore is not depressed in storage, while further it may be covered against accidental actuation by the filing system.

It will be apparent that the invention is susceptible of being practiced otherwise than as herein illustrated. For example, hook 32 need not be eccentrically mounted, nor the back be provided with a single hook. Further, head end piece 26A may be affixed to spine 24 by means other than the latch means herein described; it may, for instance, be formed as a unitary member with the spine. Also, ratchets 68 and 110 may be so arranged as to be positively locking in both directions, requiring manipulation of latch tab 106 in order to move tail end piece 26B either toward or away from head lip 31A. Then too, resilient tab 104 may be incorporated into spine 24 rather than tail end piece 26B, or located on the sides of the holder rather than the back. Additionally, the arrangement of fingers 84 and 116 of end pieces 26 may be varied, each end piece being provided, for instance, with a single central finger. Furthermore the holder may be modified so that each end has a movable end piece like tail end piece 26B.

What is claimed is:

1. In a device for filing bound items such as books, loose leaf notebooks, and the like, said bound items being characterized by having a binding with a spine terminating head and tail in edge portions, said device comprising in combination:

an elongate member longitudinally terminating in a first end and a second end spaced apart a distance substantially equal to that separating said edge portions, said member also having a back extending between said ends and a structure distal from said back which is dimensioned to fit said spine;

first and second elongate fingers disposed adjacent to said first and second ends respectively of said elongate member and attached thereto so as to be movable relative to each other between a first position and a second position, at least said first position being characterized by said first and second fingers extending toward said second and first ends respectively, said fingers also being adjacent and substantially parallel to said structure and more distal from said back than is said structure so as to accommodate between said first finger and said structure and between said second finger and said structure the said head and tail edge portions respectively of said binding; said second position being characterized by said first and second fingers being disposed further from one another than said head and tail edge portions are from one another;

defeatable restraining means for maintaining said first and second fingers in said first position; and at least one hook means on said member;

whereby one of said bound items may be detachably affixed to said elongate member by the cooperative action of said first and second finger and said elongate member may be attached to a filing system by said hook means;

the improvement wherein said defeatable restraining means comprises:

first and second interlocking means at one end of said elongate member so configured and disposed as to be movable with respect to one another between an engaged condition and a disengaged condition, said engaged condition being characterized by said first and second interlocking means being cooperatively engaged with one another so as to prevent motion of said first and second fingers at least from said first position toward said second position, and said disengaged condition being characterized by said first and second interlocking means being disposed so as to not restrict motion of said first and second fingers relative to one another;

resiliently distortable means so configured and disposed as to normally supply a first force to resiliently urge said first and second interlocking means into said engaged condition; and means for applying a second force to said resiliently distortable means so as to overcome said first force while simultaneously moving said first and second interlocking means to said disengaged condition.

2. A device for filing bound items characterized by having a binding with a spine terminating head and tail in edge portions, said device comprising in combination (a) an elongate member having hook means, and a first end and a second end spaced apart a distance substantially equal to that separating said edge portions; (b) first and second elongate fingers disposable adjacent to said first and second ends respectively of said elongate member and attachable thereto so as to be movable relative to each other between a first position and a second position, at least said first position being characterized by said first and second fingers extending toward said second and first ends respectively, said first position also being characterized by said fingers being disposed closer to one another than said head and tail edge portions of the binder are from one another; said second position being characterized by said first and second fingers being disposed further from one another than said head and tail edge portions are from one another; (c) defeatable restraining means for maintaining said first and second fingers in said first position; whereby one of said bound items may be detachably affixed to said elongate member by the cooperative action of said first and second finger and said elongate member may be attached to a filing system by said hook means; and (d) wherein said defeatable restraining means comprises:

first and second interlocking means movable with respect to one another between an engaged condition and a disengaged condition, said engaged condition being characterized by said first and second interlocking means being cooperatively engaged with one another so as to prevent motion of said first and second fingers at least from said first position toward said second position, and said disengaged condition being characterized by said first and second interlocking means being disposed so as to not restrict motion of said first and second fingers relative to one another;

resiliently-distortable means for supplying a first force to urge said first and second interlocking means into said engaged condition; and means for applying a second force to said resiliently-distortable means so as to overcome said first force and for moving said first and second interlocking means to said disengaged condition.

3. The device of claim 2 wherein the elongate member further comprises said second interlocking means; a back piece having therethrough an aperture included in the overcoming means and disposed so as to permit the manual depressing of said resiliently-distortable means; and a detachable wall section including said first finger, said resiliently distortable means and said first interlocking means.

4. The device of claim 3 wherein the elongate member and the wall section are each of a one-piece construction.

5. A device according to claim 1 wherein said elongate member is in the form of a hollow channel having a pair of separately formed end walls terminating and closing said channel and to which said fingers are attached.

6. A device according to claim 5 wherein said fingers are rigidly attached to said end walls and wherein further at least one of said pair of end walls is movable relative to said hollow channel.

7. A device according to claim 6 wherein only one of said pair of end walls is movable relative to said channel, the other of said pair being affixed to said channel by a snap connection.

8. A device according to claim 7 wherein said first and second interlocking means are affixed respectively to said channel and said one of said pair of end walls by at least one said resiliently distortable means.

9. A device according to claim 8 wherein said resiliently distortable means is integrally formed with said one of said pair of end walls.

10. A device according to claim 9 and further including a reinforcing member disposed in said channel parallel to and spaced apart from said back.

11. A device according to claim 10 wherein said channel and said reinforcing member form a guide restricting the motion of said end walls.

12. A device according to claim 11 wherein further said reinforcing member constitutes said structure dimensioned to fit said spine.

13. A device according to claim 12 wherein further said structure is curved to fit a convex spine.

14. A device according to claim 1 wherein further said interlocking means is provided with a stop means to limit the motion of said interlocking means toward said disengaged condition.

15. A device according to claim 1 or 2 wherein said first and second interlocking means are in the form of opposed ratchet means so configured and disposed as to prevent, while interlocked, motion of said first and second fingers only from said first position toward said second position and to cooperate to provide said second force to said resiliently distortable means when a third force is applied so as to move said first and second fingers from said second position toward said first position.

16. A device according to claim 15 wherein further said second finger is movable and said first finger is permanently affixed to said elongate member.

17. A device according to claim 16 wherein said hook means is disposed on said back.

18. A filing device comprising a rigid spine piece dimensioned to accommodate the spine of the binding of a book-like item to be filed, said spine piece having head and tail ends, and at least one finger at both head and tail ends dimensioned and movably disposed to engage the associated head and tail ends of the spine between themselves and the spine piece, first and second interlocking means so configured and disposed as to be engageable one with the other and, when engaged, prevent the further relative movement of the fingers and thereby maintain the book-like item captive within the holder, and resiliently distortable means biased so as to maintain said first and second interlocking means in engagement and manually distortable so as to permit the disengagement of the interlocking means and thereby the release of the binder from the document holder.

19. The filing device of claim 18 wherein the first and second interlocking means form parts of a ratchet.

20. The filing device of claim 18 further including a movable end piece integrally comprising said first interlocking means, said resiliently-distortable means and one of said fingers.

* * * * *